United States Patent [19]

Jackson

[11] Patent Number: 4,615,129

[45] Date of Patent: Oct. 7, 1986

[54] SNOW-DISPOSAL UNIT AND METHOD

[76] Inventor: Patrick H. Jackson, 240 Ayer Rd., Williamsville, N.Y. 14221

[21] Appl. No.: 808,069

[22] Filed: Dec. 12, 1985

[51] Int. Cl.[4] ..... E01H 4/00

[52] U.S. Cl. ..... 37/197; 126/343.5 R; 37/228

[58] Field of Search ..... 37/197, 199, 228, 229; 126/343.5 R

[56] References Cited

U.S. PATENT DOCUMENTS

| | | | |
|---|---|---|---|
| 3,066,428 | 12/1962 | Raiti | 37/228 |
| 3,150,000 | 9/1964 | Gontcharuk | 126/343.5 R |
| 3,304,632 | 2/1967 | Kotlar et al. | 37/228 |
| 3,309,798 | 3/1967 | Devlin et al. | 37/228 |
| 3,353,286 | 11/1967 | Marks | 37/228 |
| 3,393,462 | 7/1968 | Picker | 37/228 |
| 3,404,470 | 10/1968 | Raiti | 37/228 |
| 3,464,128 | 9/1969 | Krickovich | 37/228 |
| 3,766,586 | 10/1973 | Krickovich | 37/228 |
| 4,071,966 | 2/1978 | Cohen | 37/228 |

*Primary Examiner*—E. H. Eickholt

*Attorney, Agent, or Firm*—Christel, Bean & Linihan

[57] ABSTRACT

A mobile snow-disposal unit having a vehicle including a sealable snow-collection receptacle having a water-holding internal compartment and an engine for propelling the vehicle utilizes a vacuum pump for lowering the internal pressure of the receptacle, when sealed, and a heat exchange system for routing waste heat from the engine to the internal compartment. By lowering the internal pressure of the receptacle so that the boiling temperature of water held by the internal compartment is about equal to the temperature of the waste heat entering the internal compartment, water held within the internal compartment is converted to steam for readily melting the collected snow.

20 Claims, 4 Drawing Figures

Fig. 1.
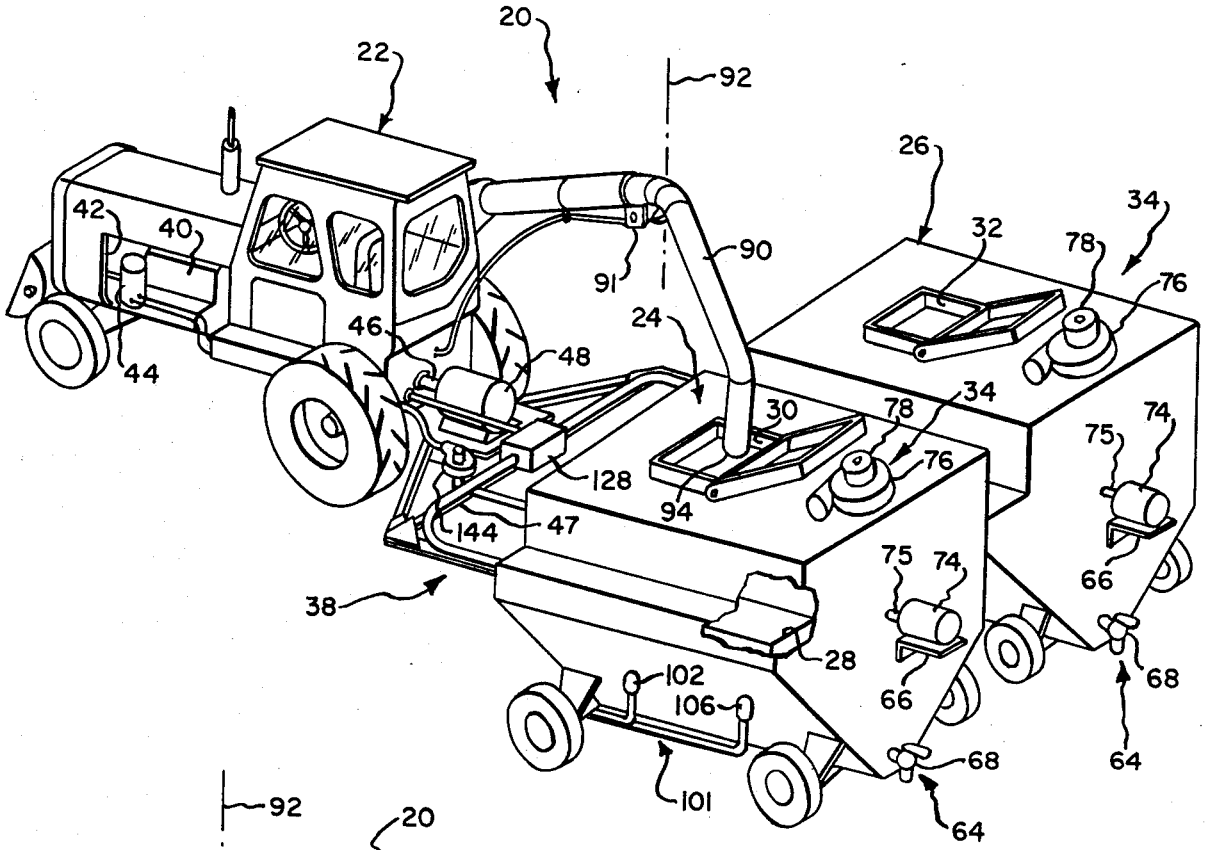
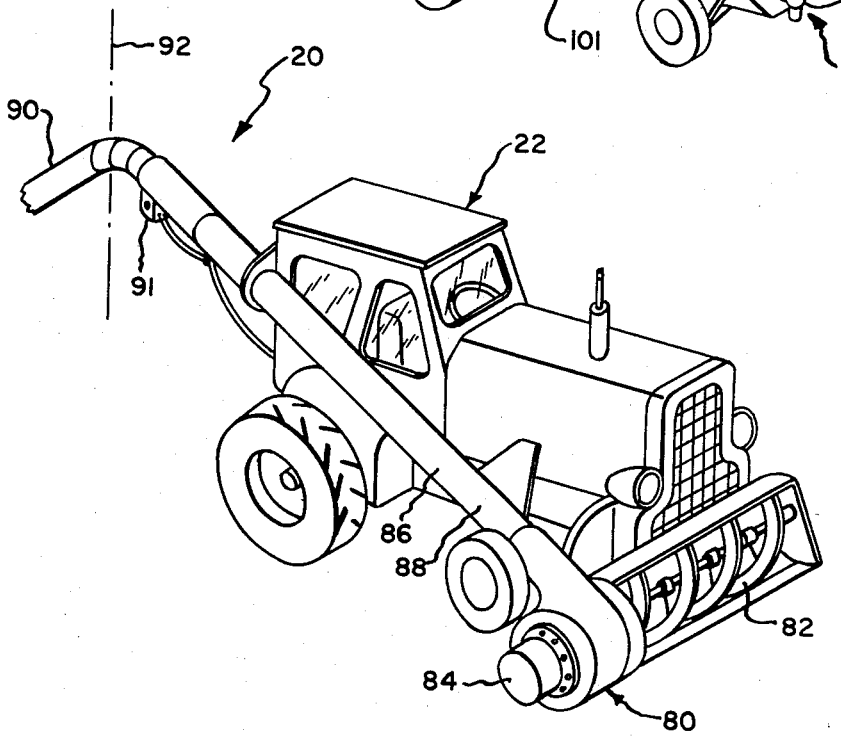
Fig. 2.

SNOW-DISPOSAL UNIT AND METHOD

BACKGROUND OF THE INVENTION

This invention relates generally to snow melting machines and relates, more particularly, to a mobile unit for collecting and melting snow for disposal.

The type of unit with which this invention is concerned commonly includes a vehicle having a snow-collection receptacle, an engine for propelling the vehicle, and means utilizing the waste heat of the engine for melting snow collected within the receptacle. An example of a unit of the aforedescribed type is shown and described in U.S. Pat. No. 969,716.

It is an object of the present invention to provide a new and improved snow-disposal unit of the aforedescribed type and an associated method for melting snow.

Another object of the present invention is to provide such a unit and method wherein waste heat of the vehicle engine is utilized much more economically and efficiently than in prior art units.

Still another object of the present invention is to provide such a unit which is economical to manufacture and effective in operation.

SUMMARY OF THE INVENTION

This invention resides in a mobile snow-disposal unit and an associated method.

The unit of the invention is comprised of a vehicle including a sealable snow-collection receptacle, vacuum means, and engine means for propelling the vehicle. The snow-collection receptacle includes an internal compartment for holding water, and the vacuum means includes a vacuum pump associated with the receptacle for lowering the internal pressure of the receptacle, when sealed, to thereby lower the boiling temperature of water held by the internal compartment of the receptacle. The unit further includes means for routing waste heat from the engine means to the internal compartment so that when the boiling temperature of water held therein is lowered by the vacuum pump to about the temperature of waste engine heat entering the compartment, the compartment water is converted to steam for readily melting the collected snow.

The method of the invention includes the initial steps of providing a vehicle including a sealable snow-collection receptacle having a water-holding compartment and an engine for propelling the vehicle. Snow is then collected in the receptacle, the receptacle is sealed, and the internal pressure of the receptacle is lowered to thereby lower the boiling point of water held by the internal compartment. Waste heat from the engine is then routed to the vehicle for boiling water held by the internal compartment to thereby readily melt the collected snow.

BRIEF DESCRIPTION OF THE DRAWING FIGURES

FIG. 1 is a perspective view of a snow-disposal unit, shown partially cutaway, in accordance with the present invention.

FIG. 2 is a perspective view of the tractor of the FIG. 1 unit as seen from an alternative angle.

DETAILED DESCRIPTION OF AN ILLUSTRATIVE EMBODIMENT

Figure 3:
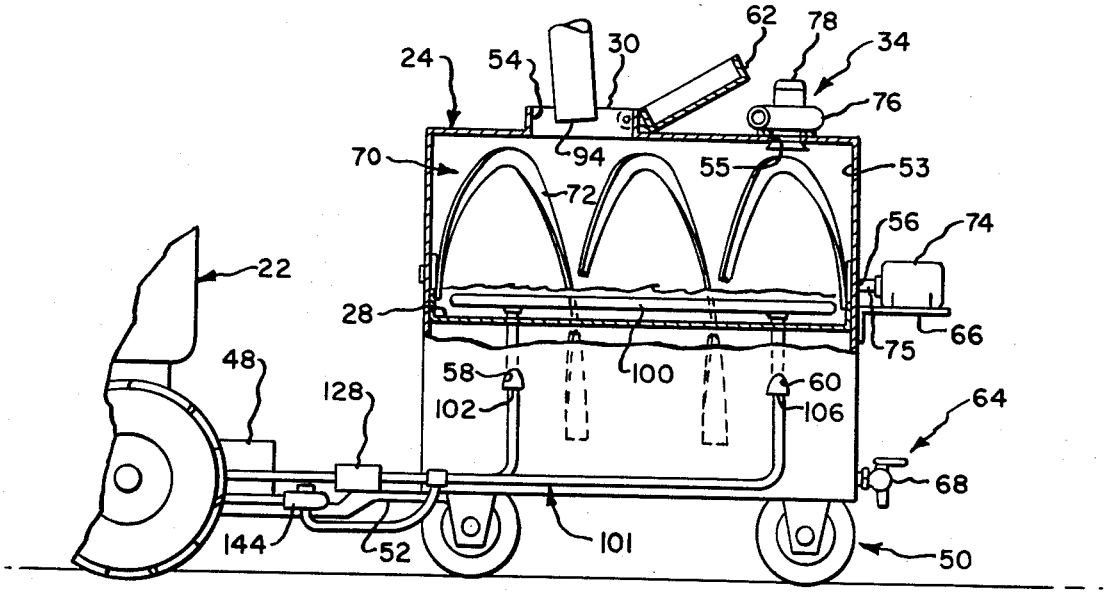
FIG. 3 is a side elevation view, shown partially in cross section, of a vehicle of the FIG. 1 unit.

Turning now to the drawings in greater detail and considering first FIGS. 1 and 2, there is shown a snow-disposal unit in accordance with the present invention and generally indicated 20. The unit 20 includes a tractor 22 and two vehicles 24,26 adapted to be pulled by the tractor 22 in side-by-side relationship. Each vehicle 24 or 26 includes a sealable snow-collecting receptacle 30 or 32, respectively, and associated with each receptacle 30 or 32 are vacuum means 34 for lowering the internal pressure of each receptacle 30 or 32. Further included in the unit 20 are means, generally indicated 38, for routing waste heat from the tractor 22 to either receptacle 30 or 32 for melting snow collected therein.

The tractor 22 of the unit 20 includes an engine 40 for providing the power with which the vehicles 24 and 26 are pulled. The engine 40 can take any of various forms but the illustrated unit 20 is in the form of a water-cooled, internal combustion engine. Associated with the engine 40 is a conventional radiator system including a radiator 42 positioned at the front of the tractor, a radiator fan and a water pump (not shown). While the engine 40 is operating, waste engine heat is directed to the radiator 42 by means of water or another suitable coolant pumped by the water pump therethrough. The engine 40 of the tractor 22 is adapted to reject heat to the radiator 42 at about 195° F. (92° C.).

Figure 4:
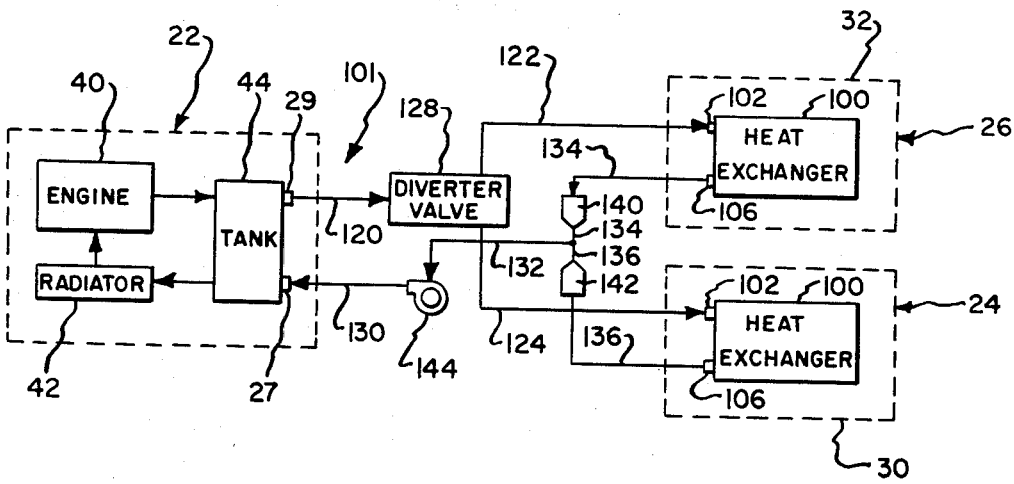
FIG. 4 is a schematic representation illustrating in block diagram form the operation of the FIG. 1 unit.

With reference to FIGS. 1 and 4, there is connected between the engine 40 and the radiator 42 a coolant reservoir 44 having inlet and outlet fittings 27 and 29, respectively. The reservoir 44 is appropriately connected with radiator hoses between the engine 40 and radiator 42 so that coolant heated by the engine 40 enters the reservoir 44 before entering the radiator 42. As will be explained in greater detail hereinafter, heated coolant collected in the reservoir 44 is routed, as desired, to the vehicles 30 and 32 to melt snow collected therein. Thus, engine coolant exiting the engine 40, when operating, is cooled by means of the radiator 42 and the associated fan or is cooled by means of snow-melting process before it is returned to the engine 40.

The tractor 22 further includes a conventional power take-off shaft 46 extending rearwardly of the tractor body and suitably geared to the crankshaft of the engine 40 for rotation therewith. Positioned below the shaft 46 and attached to the tractor body is an elongated drawbar 47 extending generally transversely of the tractor 22. Drivingly attached to the power take-off shaft 46 for a reason hereinafter apparent is an electrical generator 48 supported by the drawbar 47.

With reference to FIG. 3, there is shown a vehicle 24 of the unit 20. It will be understood that the construction of the vehicle 24 is identical to that of the vehicle 26 so that a description of the vehicle 24 will suffice. The vehicle 24 includes a wheeled trailer frame 50 having a tongue 52 adapted to be hitched to the tractor drawbar 47. The receptacle 30 of the vehicle 24 is in the form of a bin-like container 53 supported upon the frame 50 and includes an internal water-holding compartment 28 adjacent one side thereof. The receptacle 30 further includes a top opening 54, an opening 55 for the vacuum means 34, a central opening 56 defined in the rear wall of the receptacle, and side openings 58 and 60 as shown. Attached to the rear wall of the container 53 and extending rearwardly therefrom is a platform frame 66. The vehicle 24 further includes a removable closure 62 hingedly secured to the top of the container 53 for pivotal movement relative thereto between an open condition, as shown in FIG. 3 and a closed condition at which the receptacle 30 is sealed.

The internal compartment 28 extends from one end of the receptacle 30 to the other and is adapted to hold water for a reason hereinafter apparent. The top of the compartment 28 communicates with the remainder of the receptacle interior so that when water held in the compartment 28 is converted to steam in a manner hereinafter set forth, the steam is permitted to drift into the portion of the receptacle 30 where the snow is collected. Furthermore, because the internal compartment 28 is set to one side of the receptacle 30 as shown in FIG. 1, neither snow directed through the top opening 54 or melted snow which may flow down the side wall of the receptacle 30 is permitted to enter the compartment 28.

The vehicle 24 further includes valving means 64 having a valve 68 attached to the rear wall of the container 53 and adjacent the bottom thereof. As will be apparent hereinafter, the valve 68 permits an operator to drain the receptacle 30 of melted snow.

For preventing snow from packing tightly within the receptacle, the vehicle 24 includes agitator means, generally indicated 70. As shown in FIG. 3, the agitator means 70 includes a spiral ribbon-like agitator 72 and an electric motor 74. The electric motor 74 is bolted or otherwise suitably attached to the platform frame 66 and includes a rotatable shaft 75 extending through the central opening 56 of the rear container wall. One end of the agitator 72 is suitably journalled to the front wall of the container 53, and the other end of the agitator 72 is keyed or otherwise fixedly attached to the shaft 75 of the motor 74 for rotation therewith. The agitator 72 is relatively large in diameter as viewed from either of its ends so that by activating the motor 74, the agitator 72 effectively stirs the snow collected within the receptacle 30. The central opening 56 defined in the rear container wall is suitably sealed about the motor shaft 75.

The vacuum means 34 associated with the receptacle 30 includes a vacuum pump 76 and an electric motor 78 for operating the vacuum pump 76. As shown in FIG. 3, the pump 76 is attached to the top of the receptacle 30 so that its inlet communicates with the interior of the receptacle 30 through the opening 55 and its outlet is adapted to discharge air to the surroundings. Thus, when the vacuum pump 76 is operating and the receptacle 30 is sealed, the vacuum pump 76 pulls air from the interior of the receptacle 30 to thereby lower the internal pressure of the receptacle 30. The vacuum pump 76 is adapted to lower the internal pressure of the receptacle 30 from an initial pressure of about 29.9 inches (760 mm) of mercury to about 15.3 inches (388 mm) of mercury.

Referring again to FIGS. 1 and 2, the unit 20 includes conveyor means, generally indicated 80, for moving snow from ground level to the top opening 54 of the receptacle 30 or 32. The conveyor means 80 includes a horizontally-oriented auger 82 attached to the front of the tractor 22, a blower 84, and a conduit 86 attached to the outlet of the blower 84. The auger 82 is adapted to feed snow from the ground to the inlet of the blower 84 as the auger 82 is driven into snow, and the blower 84 is adapted to direct snow from its inlet, through the conduit 86 and into one of the receptacles 30 or 32.

The conduit 86 includes a first section 88 fixed in a relatively stationary condition alongside the body of the tractor 22 and includes a second section 90 hingedly connected to the free end of the first section 88 for movement about a generally vertical axis of pivot, indicated 92. The second section 90 is somewhat L-shaped as viewed along its length with one leg of the L oriented generally horizontally and the other leg, having an outlet 94, oriented generally vertically so that the outlet 94 opens downwardly. Thus, by moving the second section 90 about the pivot axis 92, the outlet 94 can be selectively positioned above the top opening 54 of either the receptacle 30 or receptacle 32. For purposes of moving the second section 90 from one vehicle receptacle to the other, a hydraulic actuator 91 is suitably attached between the first and second conduit section 86 and 88 and hydraulically connected to the tractor 24 for actuation by an operator.

In accordance with the present invention and with reference to FIGS. 1–3, the routing means 38 includes a heat exchange system for directing waste engine heat collected by the engine coolant to the internal compartment 28 of a receptacle 30 or 32. More specifically, the heat exchange system includes a heat exchanger 100 mounted within the internal compartment 28 of each receptacle 30 or 32 and flexible hoses 101 joining the heat exchangers 100,100 and the coolant reservoir 44 in a manner hereinafter described and circulating means for pumping the heated engine coolant from the reservoir 44 through a heat exchanger 100 and back to the reservoir 44. Each of the heat exchangers 100 or 100 includes a series of finned coils through which the engine coolant is directed and, as shown in FIG. 3, is mounted in the bottom of a corresponding internal compartment 28 so that the fins of the heat exchanger 100 suitably transfers heat from the coils to the interior of the compartment 28. Each of the heat exchangers 100 or 100 further includes an inlet conduit 102 and an outlet conduit 106 extending through the openings 58 and 60 in the side of a corresponding receptacle and through which the engine coolant is directed when entering and exiting the heat exchanger 100.

With reference to FIG. 4, the hoses 101 include a first set of hoses 120,122, and 124 connected between the outlet fitting 29 of the reservoir 44 and the inlets 102,102 of the heat exchangers 100,100, and a diverter valve 128 is appropriately connected in line with the hoses 120,122 and 124 so that the flow of coolant exiting the reservoir 44 through the fitting 29 can be selectively directed to the vehicle 30 or 32. A second set of hoses 130,132,134 and 136 is connected between the inlet fitting 27 of the reservoir 44 and the outlets 106,106 of the heat exchangers 100, 100 and check valves 140,142 are appropriately connected in line with the hoses 134 and 136 so that the flow of coolant exiting either of the heat exchanges 100 or 100, enters the hose 132 for passage into reservoir 44. For purposes of circulating the heat exchange medium through the heat exchange system, an electrically-powered circulation pump 144 is connected between the hoses 130 and 132 of the second hose set. As shown in FIG. 1, both the pump 144 and diverter valve 128 are supported by the tractor drawbar 47.

The electrically-powered vacuum pumps of the vacuum means 34, the agitator motor 74 and the circulation pump 144, of each vehicle 30 or 32 are suitably wired to the electrical generator 48 for receiving power therefrom when the tractor 22 is operating. Thus, the operation of the tractor engine 40 powers the generator 48 which, in turn, powers the various pumps and motors of the unit 20. Inasmuch as the tractor 22 provides power to all the electrically-driven components of the unit 20, the vehicles 24,26 do not need to be supplied with auxiliary power systems.

During a snow-disposal operation with the unit 20, one vehicle receptacle, for example receptacle 30, is preselected for filling, the top opening 54 of the receptacle 30 is then opened, the internal compartment 28 is filled with water and the second section 90 of the conveyor conduit 86 is operatively positioned above the opened receptacle opening 54. The diverter valve 128 is then adjusted so that any engine coolant exiting the reservoir 44 through the fitting 29 is directed to the heat exchanger 100 of the receptacle 30 chosen for filling. The tractor engine 40 and the circulation pump 144 are activated so that waste heat from the engine 40 collected by the engine coolant is routed to the heat exchanger 100 in the receptacle 30 so that the internal temperature of the internal compartment 28, and thus the water contained therein, is thereby heated. The conveyor means 80 is then utilized to fill the receptacle 30 with snow, and then the closure 62 is moved to a closed condition to thereby seal the receptacle 30. At that point, the vacuum means 34 is energized to lower the internal pressure of the receptacle 30 so that the boiling point of the water contained within the internal compartment 28 is lowered to about the temperature of the coolant circulating through the heat exchanger 100. More specifically, the vacuum means 34 lowers the internal pressure of the receptacle 30 from an initial (i.e. atmospheric) pressure of about 29.9 inches (760 mm) of mercury to about 15.3 inches (388 mm) of mercury at which water boils at about 180° F.(82° C.). The heat exchange system of the routing means 38 is sufficiently efficient to route waste heat from the tractor 22, at which the coolant 42 is heated to about 195° F. (91° C.), to a receptacle 30 or 32 for heating the corresponding internal compartment 28 so that the water held by the compartment 28 is converted to steam. The generated steam subsequently drifts from or otherwise leaves the compartment 28 and contacts the collected snow so that the snow is readily melted.

Inasmuch as snow cannot be directed into the vehicle 24 when the receptacle 30 is sealed, the additional vehicle 26 with receptacle 32 provides means whereby snow can be continually collected. More specifically, while one vehicle receptacle 30 or 32 is being filled, the other vehicle receptacle can be sealed and the snow melted therein, and vice versa. For draining a vehicle 30 or 32 of melted snow, the vehicle 30 or 32 can be driven to a storm sewer and emptied as the melted snow is directed through the valve 68 and into the sewer.

It follows from the above that the unit 20 utilizes waste heat from the tractor 22, which would otherwise be dissipated to the atmosphere through the radiator 42, to generate steam in an economical and effective manner within the receptacle 30 or 32 to melt snow.

It will be understood that numerous modifications and substitutions can be had to the aforedescribed embodiments without departing from the spirit of the invention. For example, although the aforedescribed pumps and motors have been described and shown as being electrically-driven by means of an electrical generator coupled to the power take-off shaft 46 of the tractor 22, it will be understood that several of these components can be mechanically driven and appropriately coupled to the power take-off shaft for receiving mechanical operating power therefrom. Furthermore, automatic controls such as a thermostat for sensing the temperature of the coolant contained within the reservoir 44 can be connected to the electric circulation pump 144 for automatically initiating the circulation of heated engine coolant through one of the heat exchangers 100,100. Accordingly, the aforedescribed embodiments are intended for purposes of illustration and not as limitation.

I claim:

1. A method for melting snow for disposal comprising the steps of:

providing a vehicle including a sealable snow-collection receptacle having a water-holding internal compartment and an engine for propelling the vehicle;

collecting snow in said receptacle;

sealing said receptacle;

lowering the internal pressure of said receptacle to thereby lower the boiling point of the water held by said internal compartment;

routing waste heat from the engine to said internal compartment for boiling the water held therein and thereby readily melting the collected snow.

2. A method as defined in claim 1 wherein said step of routing includes the steps of providing a heat exchange system operatively connected between the engine and said receptacle and circulating a heat exchange medium through said system for routing waste heat from said engine to said internal compartment.

3. A method as defined in claim 2 wherein said engine is water-cooled engine, said heat exhange system includes a heat exchanger mounted in heat exchange relationship with the internal compartment, and said step of routing directs waste engine heat collected by engine coolant into said internal comparment by means of said heat exchange system.

4. A mobile snow-disposal unit comprising:

a vehicle including a sealable snow-collection receptacle having an internal compartment for holding water;

vacuum means including a vacuum pump associated with said receptacle for lowering the internal pressure of said receptacle, when sealed, to thereby lower the boiling temperature of water held by said internal compartment;

engine means for propelling said vehicle; and means for routing waste heat from said engine means to said internal compartment so that when the boiling temperature of water held by said internal compartment is lowered by said vacuum pump to about the temperature of waste heat routed to said internal compartment, water held by said internal compartment is converted to steam for readily melting the collected snow.

5. A unit as defined in claim 4 wherein said engine means includes a water-cooled engine through which a coolant is circulated and said means for routing includes means for transferring engine heat collected by the coolant to said internal compartment.

6. A unit as defined in claim 5 wherein said means for routing includes a heat exchanger associated with said internal compartment and means for circulating the heated engine coolant through said heat exchanger.

7. A unit as defined in claim 6 wherein engine means includes a reservoir through which heated engine coolant is routed and said circulating means includes a network of conduits connected between said reservoir and said heat exchanger.

8. A unit as defined in claim 6 wherein said circulating means includes a circulating pump for circulating the coolant through said heat exchanger and said circulation pump is connected to said engine means for receiving operating power therefrom.

9. A unit as defined in claim 8 wherein said engine means includes a power take-off shaft which is rotatable when said engine means is operating and said circulation pump is connected to so as to receive operating power from said power take-off shaft.

10. A unit as defined in claim 9 further comprising an electric generator connected in driven relationship with said power take-off shaft and wherein said circulation pump is electrically-powered and wired to said generator for receiving operating power therefrom.

11. A unit as defined in claim 4 wherein said engine means includes a power take-off shaft which is rotatable when said engine means is operating and said vacuum pump is connected so as to receive operating power from said power take-off shaft.

12. A unit as defined in claim 11 further comprising an electric generator connected in driven relationship with said power take-off shaft and wherein said vacuum pump is electrically-powered and wired to said generator for receiving operating power therefrom.

13. A unit as defined in claim 4 further comprising conveyor means associated with said vehicle for directing snow into said receptacle.

14. A unit as defined in claim 4 wherein said receptacle includes valving means for draining said receptacle of melted snow.

15. A unit as defined in claim 4 wherein said engine means includes a wheeled tractor operatively hitched to said vehicle for pulling said vehicle.

16. A unit as defined in claim 4 wherein said vehicle includes agitator means mounted within the interior of said receptacle for preventing collected snow from packing tightly.

17. A unit as defined in claim 4 wherein said vehicle is a first vehicle, said vacuum pump is a first vacuum pump, and said unit further comprises a second vehicle including a second sealable snow-collection receptacle having an internal compartment for holding water, a second vacuum pump associated with said second receptacle for lowering the internal pressure of said second receptacle, when sealed, to thereby lower the boiling temperature of water held by said internal compartment of said second vehicle, and means for selectively routing waste heat from said engine means to said first vehicle internal compartment or to said second vehicle internal compartment.

18. A mobile snow-disposal unit comprising:

a vehicle including a snow-collection receptacle having an opening through which snow is directed into said receptacle, a removable cover being securable over said receptacle opening to sealingly close said receptacle, and an internal compartment for holding water;

vacuum means including a vacuum pump associated with said receptacle for lowering the internal pressure of said receptacle, when sealed, to thereby lower the boiling temperature of water held by said internal compartment;

engine means associated with said vehicle and said vacuum pump for propelling said vehicle and powering said vacuum pump, said engine means including a water-cooled engine through which a coolant is circulated; and a heat exchange system including a heat exchanger mounted within said internal compartment and means for routing heat collected by the coolant from said engine to said heat exchanger for transfer to said internal compartment so that when the boiling temperature of snow collected within said receptacle is lowered by said vacuum pump to about the temperature of the coolant entering said heat exchanger, water held by said internal compartment is converted to steam for readily melting the collected snow.

19. A unit as defined in claim 18 wherein said means for routing includes means for circulating heated engine coolant through said heat exchanger.

20. A unit as defined in claim 19 wherein said means for circulating includes a network of conduits connected between said engine means and said heat exchanger and a circulating pump for circulating the coolant through said heat exchanger and said circulation pump is connected to said engine means for receiving operating power therefrom.

* * * * *